United States Patent [19]

Stahlecker et al.

[11] Patent Number: 4,516,396

[45] Date of Patent: May 14, 1985

[54] OPEN END YARN SPINNING APPARATUS

[75] Inventors: Fritz Stahlecker, Josef-Neidart-Str. 18, Bad Überkingen, Fed. Rep. of Germany; Hans Raasch, Monchen-Gladbach, Fed. Rep. of Germany

[73] Assignees: Fritz Stahlecker; Hans Stahlecker, both of Fed. Rep. of Germany

[21] Appl. No.: 552,741

[22] Filed: Nov. 17, 1983

[30] Foreign Application Priority Data

Dec. 22, 1982 [DE] Fed. Rep. of Germany ..... 3247411

[51] Int. Cl.[3] ..... D01H 7/882

[52] U.S. Cl. ..... 57/407; 57/105; 57/1 R

[58] Field of Search ..... 57/1 R, 104, 404, 105, 57/406, 407, 415, 411

[56] References Cited

U.S. PATENT DOCUMENTS 3,511,045 5/1970 Bures et al. ..... 57/407
3,807,157 4/1974 Stahlecker ..... 57/407 X
3,861,132 1/1975 Stahlecker et al. ..... 57/407
3,874,154 4/1975 Stahlecker et al. ..... 57/407
4,245,460 1/1981 Staufert et al. ..... 57/407 X

*Primary Examiner*—John Petrakes
*Attorney, Agent, or Firm*—Bell, Seltzer, Park & Gibson

[57] ABSTRACT

An open end yarn spinning apparatus is disclosed which comprises a plurality of side by side spinning positions, and which is characterized by the ready accessibility of the internal components of each spinning position without interference with an adjacent position. The apparatus includes a central frame extending longitudinally along the length of the apparatus, and each spinning position includes a frame subassembly composed of two longitudinally spaced apart and transversely directed plate-like side members, and a plurality of longitudinally extending braces which interconnect the two side members. The bearing assembly for the rotor, and the feed and opening rolls are mounted to the frame subassembly, and the rotor housing is releaseably mounted to the frame subassembly so that removal thereof exposes the internal components.

22 Claims, 10 Drawing Figures

28
37
25
27
24
26
8
7
1
2
38
22
21
34
36
18
19
33
42
39
35
17
9
41
29
6
13
40
5
12
93
45
32
4
14
30
31
11
16
15
10
46
20
3
53
54
59
55
57
51
58
47
56
52
43
50
48
49
44
23

A 121
122
37
36
109
110
107
34
19
61
20
108
17
106
105
29
101
A
14
11
15
10
30
63
98
14
75
16
53
100
143
78
59
77
99
76
97
72
23

OPEN END YARN SPINNING APPARATUS

The present invention relates to an open end yarn spinning apparatus comprising a plurality of side by side spinning positions, and which is characterized by the internal components of each spinning position being readily accessible without affecting adjacent positions.

Each spinning position of a conventional open end yarn spinning apparatus typically includes a spinning rotor mounted to a rotor shaft, with the shaft being supported in a bearing in a manner which permits the rotor and shaft to be withdrawn forwardly and removed. Also, the rotor is closely surrounded by a rotor housing, with the housing having a rear wall through which the rotor shaft extends. An insert is disposed adjacent the forward side of the rotor, and the insert includes at least a portion of a fiber feed duct and a yarn removal duct. The insert is mounted on a pivotable cover so that it may be withdrawn from the rotor for the purpose of opening the spinning position. The cover also acts to shield a feed and fiber separating system which is arranged below the rotor housing.

An open end yarn spinning machine of the above described type is manufactured by W. Schlafhorst & Co., Germany, under the trade designation Spinncenter Autocoro. In this apparatus, the bearing for each spinning rotor is accommodated inside a duct which extends along the length of the entire machine, and which is composed of several subassemblies, each corresponding to the length of several spinning positions. The operating side of the duct includes a wall which extends over several spinning positions, and which is detachably mounted to the remaining portion of the duct and supports the housings which surround the rotors. This type of construction is relatively labor intensive, particularly when it is desired to remove one or several bearings of the spinning rotors. In such event, a relatively time-consuming disassembly operation is required, which also affects the adjacent spinning positions.

It is accordingly an object of the present invention to provide an open end yarn spinning apparatus of the described type which provides for greatly improved accessibility to the individual components of each spinning position, and particularly to the bearings for the spinning rotors.

It is a further object of the present invention to provide an open end yarn spinning apparatus of the described type wherein each spinning position may be disassembled without affecting adjacent spinning positions.

These and other objects and advantages of the present invention are achieved in the embodiments illustrated herein, by the provision of an open end yarn spinning apparatus which comprises a plurality of side by side spinning positions, with each position including a circular spinning rotor which has a rearwardly extending shaft fixed thereto, bearing means rotatably mounting the rotor shaft so as to permit axial withdrawal of the rotor and rotor shaft, a rotor housing generally surrounding the rotor and having a rear wall with an opening receiving the rotor shaft therethrough, and fiber delivery means including a feed roll, an opening roll, and a fiber delivery duct. Also, each spinning position includes a pivotable cover which mounts a closure insert which is adapted to overlie the rotor when the rotor is closed, with the closure insert including a portion of the fiber delivery duct and a yarn removal duct.

In accordance with the present invention, the apparatus further comprises a central frame extending along the longitudinal length of the apparatus, and a frame subassembly fixedly mounted to the central frame at each of the spinning positions, with each frame subassembly comprising a pair of longitudinally spaced apart side members fixed to the central frame and extending generally parallel to each other in the transverse direction. Each frame subassembly further includes support means extending longitudinally between and fixed to each of the associated side members. The bearings for rotatably mounting the rotor shaft are mounted to the frame subassembly, as are the feed roll and the opening roll of the fiber delivery system. Further, means are provided for mounting the rotor housing of each spinning position to the associated frame subassembly in a manner which permits the ready release and removal thereof the provide access to the other internal components of the spinning position.

In the preferred embodiment, the side members of each frame subassembly are each in the form of a generally flat metal plate, and the support means of each frame subassembly comprises a plurality of separate braces fixed to each of the associated side members. By this arrangement, the pivotal opening of the cover, and the removal of the spinning rotor and rotor housing liberally expose the interior area of the spinning position, so that the individual components are readily accessible for an inspection, maintenance, replacement, or the like, and without thereby interfering with adjacent spinning positions.

In one advantageous embodiment, the side members are fabricated by die cutting and forming a sheet of metal, which permits mass production with very high precision, and so that the other components which are attached to the side members will be accurately aligned to each other in a simple manner and without requiring substantial labor.

Some of the objects and advantages of the invention having been stated, others will appear as the description proceeds, when taken in connection with the accompanying drawings, in which FIG. 1 is a vertical sectional view of an open end yarn spinning apparatus embodying the present invention and taken medially through a spinning position;

FIG. 2 is a fragmentary sectional view of a portion of the apparatus shown in FIG. 1, and with the cover pivoted downwardly to the open position, and with the rotor and rotor housing having been removed;

FIGS. 2A and 2B schematically illustrate the rotor and rotor housing which have been removed from the apparatus shown in FIG. 2;

Figure 1:
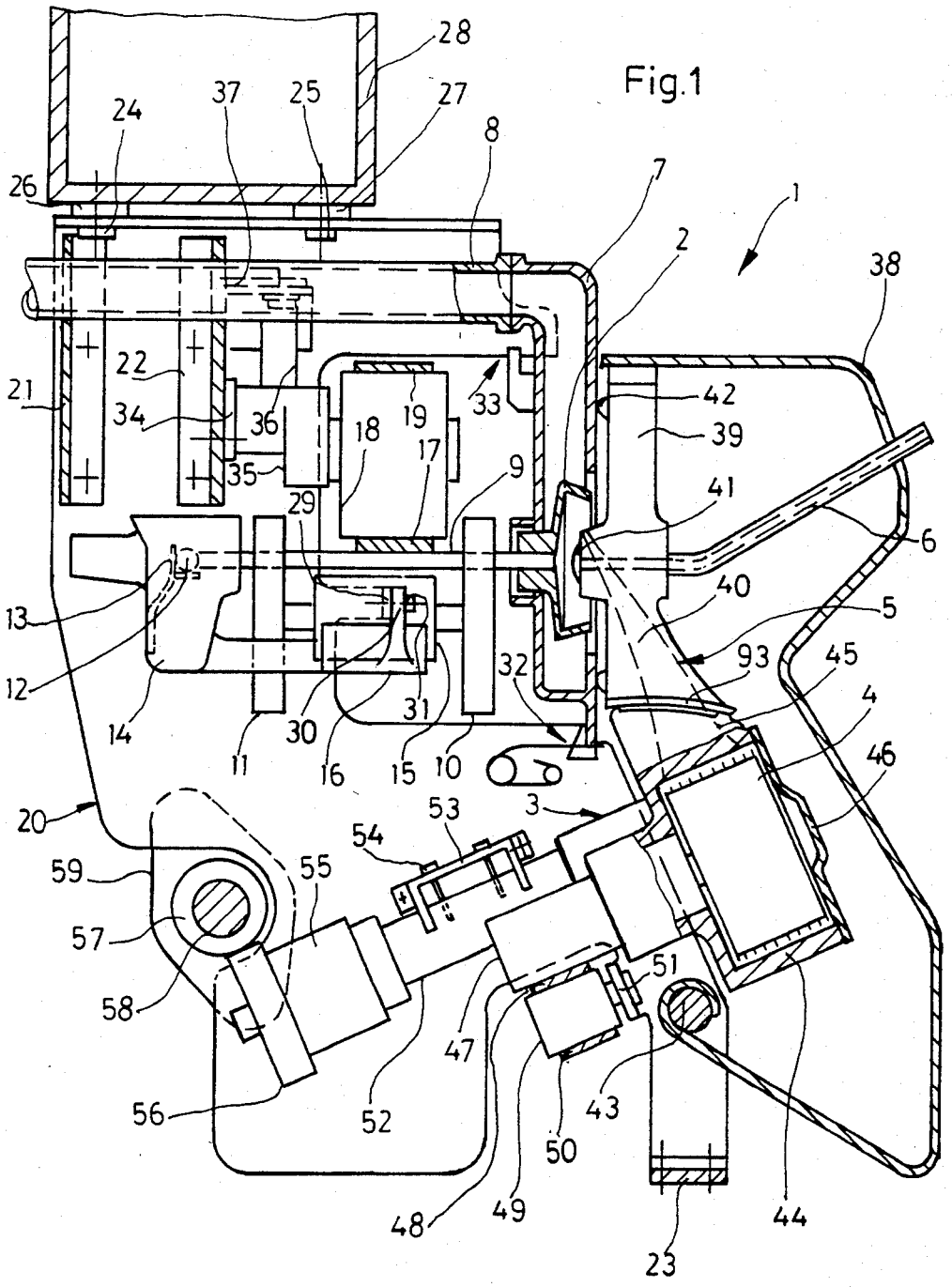
Figures 2, 2A, 2B:
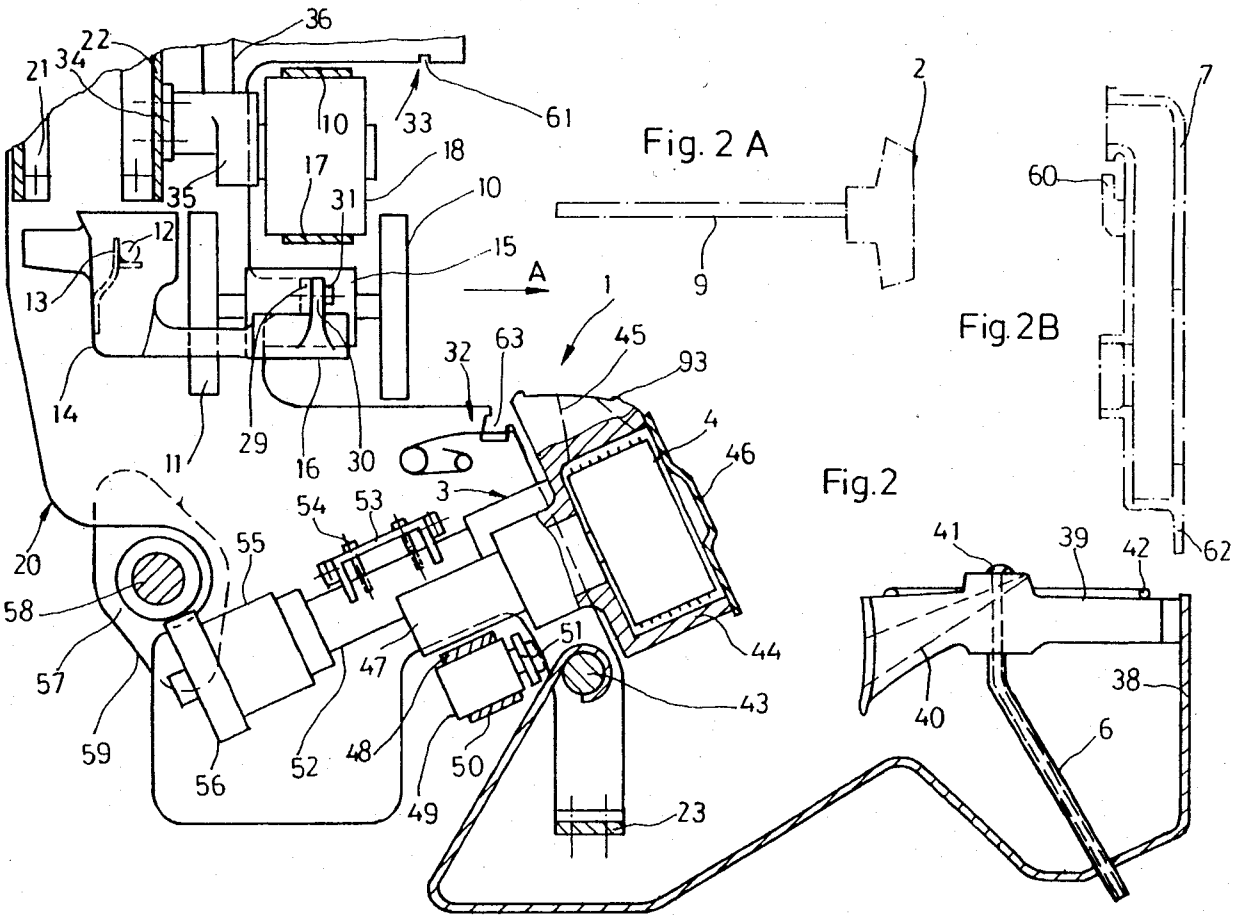
Figure 3:
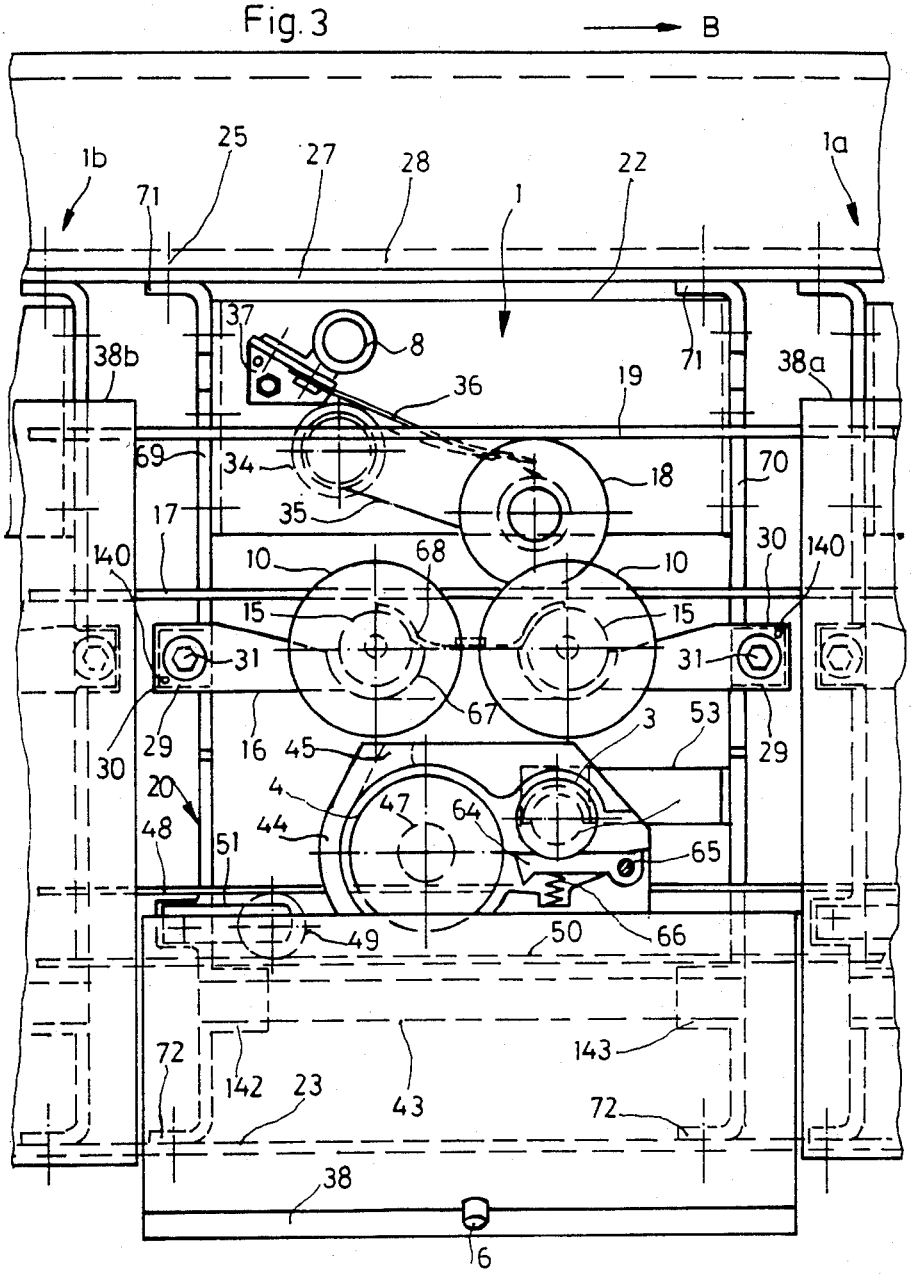
FIG. 3 is a front elevation view of the spinning position shown in FIG. 1, and with the cover having been lowered.

Referring more particularly to the drawings, FIGS. 1–3 illustrate one spinning position of an open end yarn spinning apparatus, it being understood that the apparatus is composed of a number of such positions disposed in a side by side relationship, as indicated at 1, 1*a*, and 1*b* in FIG. 3. Each spinning position includes a spinning rotor 2 having an open forward side facing toward the right in FIG. 1, and a rearward side having a rotor shaft 9 coaxially fixed thereto. The rotor 2, which is driven at very high speeds, receives individual yarn fibers from the fiber feed duct 5 to form a band of fibers which is subsequently withdrawn as a twisted yarn through the yarn delivery duct 6. The duct 6 includes a delivery nozzle 41 positioned adjacent the forward side of the rotor 2. The resulting yarn is then wound by a takeup system (not shown) into a cross wound package. The fiber material is supplied from a can or the like in the form of a sliver to the feed and fiber separating system, which includes a feed roll 3 cooperating with a feed table 64 (FIG. 3). The feed roll 3 supplies the sliver to an opening or combing roll 4 which rotates in the same direction, but at a significantly higher speed, so as to separate the individual fibers. The opening roll 4 then feeds the separated fibers through the two-part feed duct 5 to the open forward side of the rotor 2.

The horizontally arranged shaft 9 of the spinning rotor is mounted by bearing means which includes two pairs of supporting discs 10 and 11, with one disc of each pair being mounted on a common shaft. The discs of each pair are longitudinally separated and aligned so as to support the rotor shaft 9 in a wedge-like gap formed between the outer surfaces of each pair of discs and as best seen in FIG. 3. Axially, the shaft 9 abuts a spherical ball bearing 12, which is arranged in a resilient holder 13 inside of the housing 14. The shaft 9 is directly driven by a tangential belt 17, which extends in the longitudinal direction B of the apparatus (FIG. 3) and also drives the shafts 9 of the rotors of the other spinning positions. An axial thrust is produced by reason of the running direction of the tangential belt 17 and a slightly skewed relative position of the discs 10 and 11, which thrust is directed against the ball bearing 12. The common supporting shafts of the discs 10 and 11 are each supported in a bearing 15, with the two bearings 15 being in turn supported in the two dish-shaped recesses 67 of the bearing support bracket 16. The bearings 15 are held by a resilient clamp 68 (FIG. 3). The tangential belt 17 is biased toward the shaft 9 by a tensioning roll 18, which is supported on a pivoting arm 35. The arm 35 is adapted to pivot about a post 34, and is biased downwardly by a leaf spring 36.

The feed roll 3 of each spinning position is supported in a housing 52, and is driven by means of a shaft 58 which extends in the longitudinal direction B along the apparatus. At each spinning position, the continuous drive shaft 58 is provided with a gear 57, which engages a gear 56, and the gear 56 is operatively connected to the roll 3 via a releasable coupling 55, so that the feed roll 3 of each spinning position may be individually shut down.

The opening roll 4 is enclosed by a housing 44, which also accommodates the bearing for the roll 4. A whorl 47 coaxially extends from the roll 4, and is driven by a tangential belt 48. The tangential belt 48 is tightened by a tensioning roll 49 in the area of the roll 4, and the return run 50 of the belt is guided along the opposite side of the tensioning roll 49. The housing 44 of the opening roll 4 is mounted to the housing 52 of the feed roll 3 so that the roll 4 can pivot about the axis of the feed roll 3, with the drive whorl 47 being lifted from the tangential belt 48, so that its drive is discontinued. A cover 46 (FIG. 1) overlies the forward side of the housing 44. Also, the feed table 64 is mounted in the housing 44 and cooperates with the feed roll 3, with the table 64 being mounted so as to pivot about a pin 65 while being biased by a spring 66 against the feed roll 3.

As best seen in FIG. 1, the opening roll housing 44 is urged against the biasing force of a spring (not shown), by a closure insert 39 which is attached to the cover 38. The insert 39 thereby biases the housing 44 to its operating position. The cover 38 is adapted to pivot about the axis of the shaft 43 which is located below the housing 44, and sliding guide surfaces 93 are provided between the housing 44 which contains a portion 45 of the fiber feed duct 5, and insert 39 which contains a second portion 40 of the fiber feed duct. These sliding guide surfaces 93 cause the opening roll housing 44 to pivot about the axis of the feed roll 3 when the cover is closed.

A rotor housing 7 generally surrounds the periphery of the spinning rotor 2, and is connected to a suction line 8, through which a partial vacuum is produced at the rotor 2. The vacuum assists in transporting the fibers from the opening roll 4 to the rotor 2. The rotor shaft 9, or a ring collar at the rearward side of the rotor 2, extends through a rear wall opening in the housing 7. A seal may be provided between the rotor shaft and housing in the manner described below in conjunction with FIG. 8. The forward side of the rotor housing 7 is open in the area corresponding to the periphery of the rotor 2, but this area is closed by the closure insert 39 which engages the forward side of the rotor housing 7 with a continuous seal 42.

The yarn spinning apparatus further comprises a central frame 28 extending along the longitudinal length of the apparatus in the direction B (FIG. 3) and a frame subassembly 20 is fixedly mounted to the central frame 28 at each of the spinning positions 1, 1*a*, and 1*b* as seen in FIG. 3. Each frame subassembly 20 comprises a pair of longitudinally spaced apart side members 69 and 70 which are fixed to the central frame 28 and extend generally parallel to each other in the transverse direction. Further, each frame subassembly includes support means extending longitudinally between and fixed to each of the associated side members. In the embodiment of FIGS. 1–3, this support means is composed of three separate braces 21, 22 and 23 which extend in the longitudinal direction B and are fixed to each of the side members 69 and 70. The side members 69 and 70 are composed of generally flat metal plates, which have been die cut and formed into the desired profile.

The upper edges of the side members 69 and 70 each include an angled flange 71, which is joined to the central frame 28 by means of bolts 24 and 25 and washers 26 and 27. The two braces 21 and 22 are of the same configuration and are arranged in the upper portion of the frame subassembly and adjacent the central frame 28, whereas the brace 23 is disposed in the lower portion of the subassembly and is thus remote from the central frame 28. Each of the braces 23, which are bolted to the lower angled flange 72 of each of the side members 69 and 70, extends beyond the subassembly so that it is connected with the adjacent spinning position 1*a* or respectively 1*b*. Thus a continuous connection is formed between the side members 69 and 70 of the individual spinning positions along the lower portion of the subassemblies.

Figure 4:
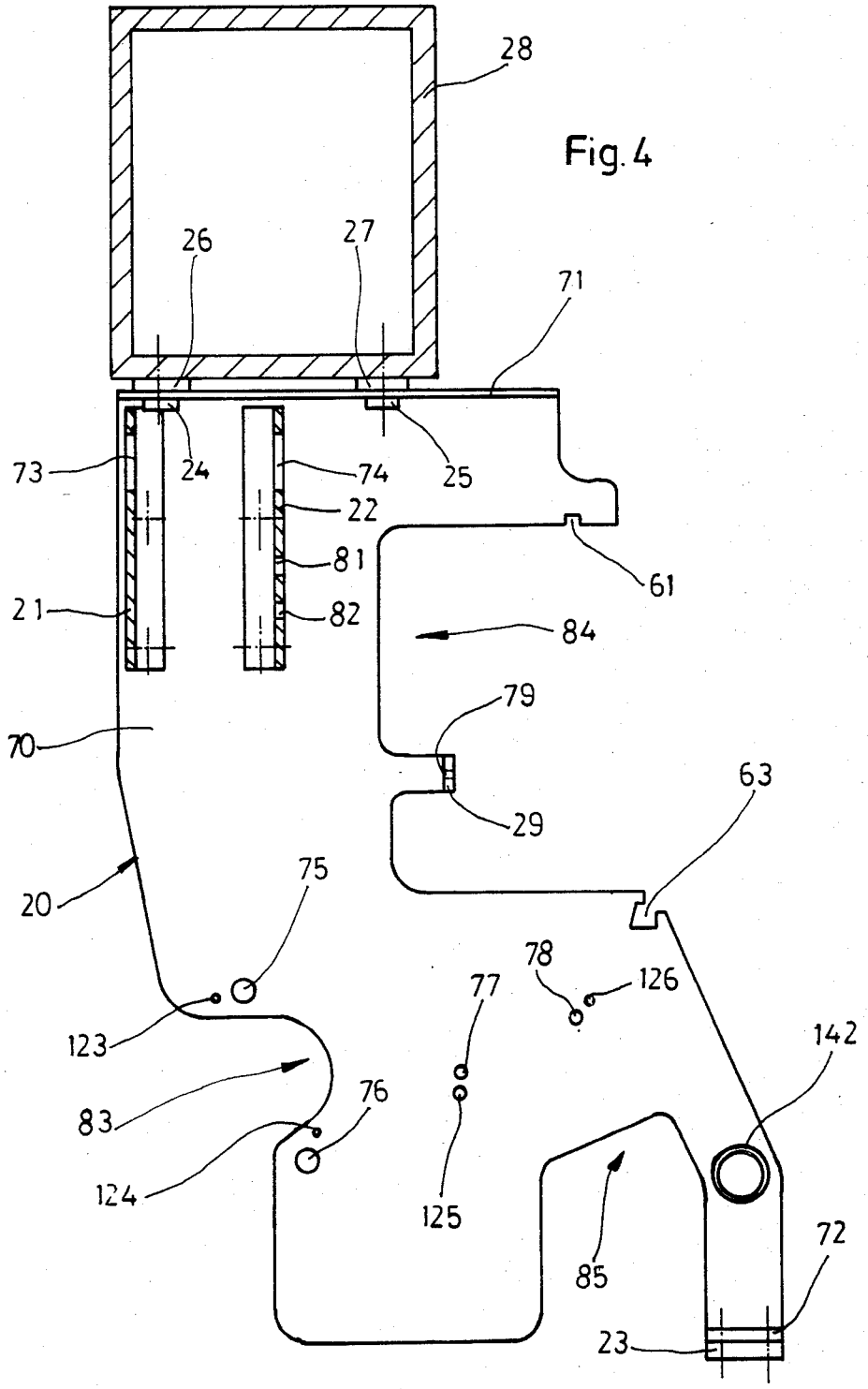
FIG. 4 is a view similar to FIG. 1, but with all of the internal components of the spinning position having been removed.

As best seen in FIG. 4, each of the side members 69 and 70 includes a forward edge having a rearwardly extending recess 84. Also, the members each have a rearward edge which includes a recess 83, and a lower edge which includes a recess 85. The tangential drive belt 17 extends through the recesses 84 of the side members, and the upper run 19 of the belt is supported on the tensioning roll 18. Also, a connecting finger extends into the area of the recess 84, and the outer portion of the connecting finger is turned outwardly to form a mounting flange 29. The bearing support bracket 16 is attached between respective ones of these flanges 29, with the bracket 16 including opposite ends 30 which are disposed against the flanges 29 and joined thereto by means of bolts 31. The housing 52 for the feed roll 3 is arranged somewhat below the bearing bracket 16 and is oriented in an upwardly inclined relation with respect to the cover 38, so that upon loosening the bolts 31, the bearing bracket 16 may be lowered and then removed forwardly below the tangential belt 17. The thrust bearing housing 14 is mounted to the bearing bracket 16 by means of fork-like arms which extend outside the supporting discs 11, so that the thrust bearing housing 14 may also be removed with the bearing bracket 16. In order to be able to remove and install the bearing bracket 16 without adjustment problems, there may further be provided alignment means on the respective contiguous surfaces of the flanges 29 and ends 30 for facilitating the initial alignment thereof during the assembly procedure. This alignment means is in the form of a pin and bore as indicated at 140 in FIGS. 3 and 6.

As will be understood, before the bearing bracket 16 can be removed, the cover 38 must be lowered by pivoting it about the shaft 43, and the spinning rotor 2 and shaft 9 must be withdrawn in the forward direction as indicated at A, and the rotor housing 7 removed, note FIGS. 2, 2A and 2B.

The rotor housing 7, which is preferably fabricated from a plastic material, includes a generally square base surface and covers the area extending above the opening roll housing 44 between the two side members 69 and 70. The housing 7 is detachably mounted on the side members 69 and 70 by means of the connections 32 and 33. More particularly, the sides of each recess 84 are provided with upper and lower slots 61 and 63 respectively, which open generally toward each other. Also, the rotor housing 7 includes a pair of separate arms 89 which define an upper tongue 60, and the lower edge of the housing 7 defines a continuous lower tongue 62, and the two oppositely directed tongues 60 and 62 are adapted to be received in respective ones of the slots 61 and 63. In addition, the housing 7 is designed so that it may be inserted from above, with the tongue 62 being inserted into the slot 63, and the tongue 60 then being inserted from below into the slot 61. The lower slot 63 is sufficiently deep so that the tongue 62 may be inserted to an extent such that the tongue 60 may be brought below the slot 61. The housing 7 is then lifted so that the tongue 60 moves into the slot 61, with the tongue 62 however remaining in the slot 63. The slot 63 into which the tongue 62 is first inserted, is further designed so that the tongue 62 may be obliquely inserted, and the rotor housing 7 can be pivoted about the area of the slot 63 until the tongue 60 is aligned with the slot 61. For this purpose, each slot 63 is in the form of two laterally spaced apart guide surfaces for the tongue 62, which are staggered to each other in height, and the slot 63 is enlarged in the area below the upper or left guide surface as best seen in FIG. 5.

Figure 5:
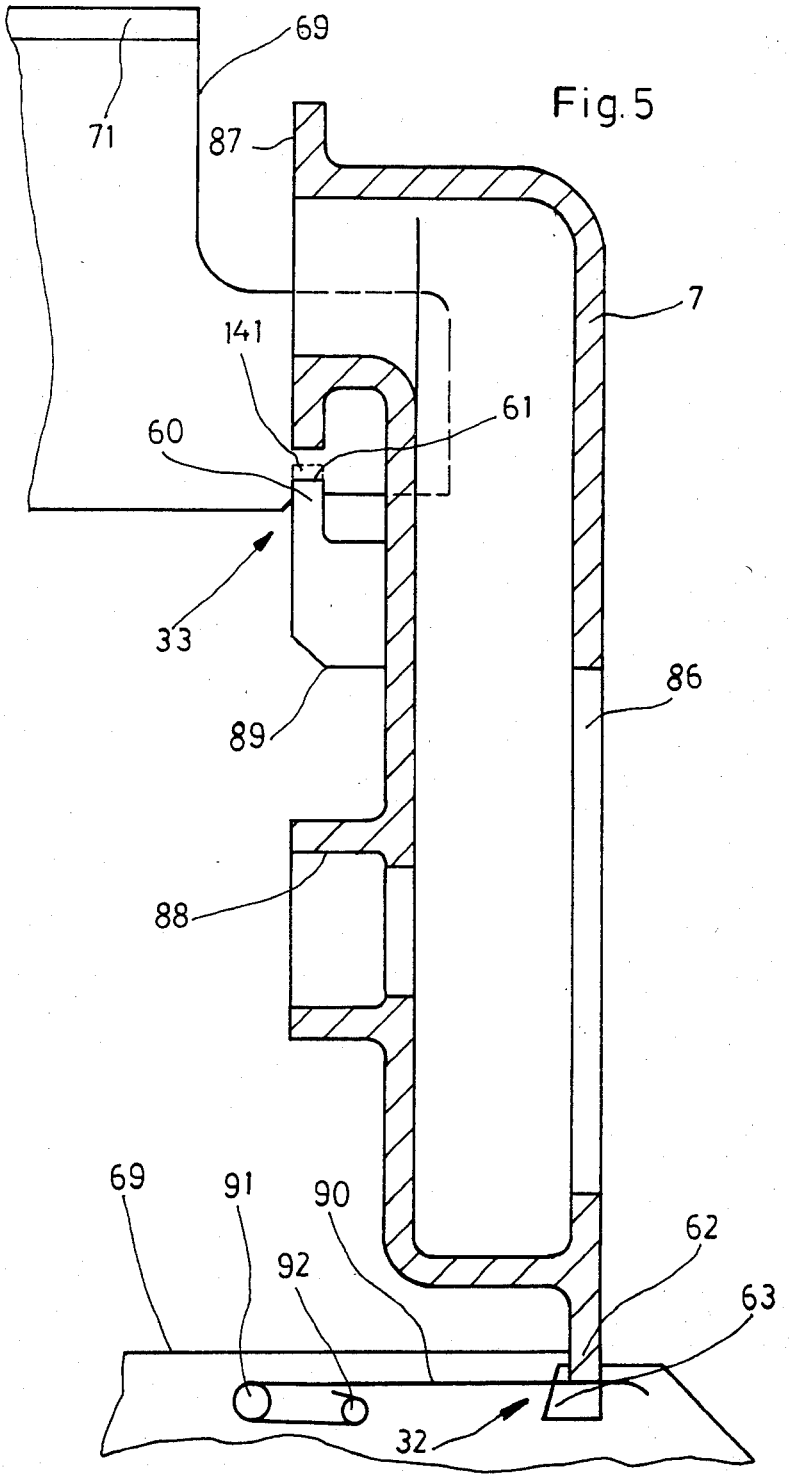
FIG. 5 is a vertical sectional view of the rotor housing and adjacent portions of one of the side members of the frame subassembly.

A leaf spring 90 is positioned in the area of the slot 63 on each side member 69 and 70, and the springs engage the tongue 62 of the housing 7 so that it is lifted to its operating position as shown in FIG. 5, and wherein the tongue 60 is retained in the slot 61. Each leaf spring 90 loops around two pins 91 and 92. Also, the tongue 60 is provided with notches 141, which correspond to the thickness of the associated side member 69 or 70, so that when the tongue 60 is moved into the slot 61, the rotor housing 7 is laterally stabilized. Thus in its operating position, the rotor housing 7 rests upon the leaf springs 90. As will be understood, it is also possible to interchange the arrangement of the slots 61 and 63, i.e., the slot 63 may be arranged in the upper side of the recess 84, and the slot 61 in the lower side thereof so that the rotor housing 7 would be assembled by first inserting its tongue 60, and subsequently its tongue 62. The advantage of this latter embodiment is that in its operating position the rotor housing would rest with its own weight on the bottom of the then lower slot 61. In such embodiment, it should be noted that the upper slot 63 into which the tongue 60 is first inserted, would be so arranged that it is possible to pivot the rotor housing about the area without interference by the flange 87 which is associated with the suction line 8. On its forward side, the rotor housing 7 includes a circular opening 86, the diameter of which is slightly larger than that of the largest rotor 2 to be used. On its rearward side, the rotor housing 7 includes an opening which is defined by a ring collar 88, and which preferably accommodates a seal as described below with reference to FIG. 8.

For attaching the housing 52 of the feed roll 3 to the frame subassembly 20, there is provided a U-shaped bracket 53 which is attached to the housing 52 by means of bolts 54, note FIGS. 1–3. The bracket 53 is provided with a flange at its end which is bolted to the side member 70. There may also be provided adjusting pins 125, 126 (FIG. 4) and bores 99, 100 (FIG. 7) between the flange of the bracket 53 and the side member 70, by which the bracket 53 may be accurately aligned so that its exact position remains insured upon installation and removal. By loosening the bracket 53 from the side member 70, the entire feed and fiber separating assembly may be removed in a simple manner. As best seen in FIGS. 1 and 3, the side members 69 further include a flange within the recess 85 for mounting a holding bracket 51 which is bolted thereto, and which in turn supports the tensioning roll 49 of the tangential belt 48, 50 for driving the opening roll 4 by contact with the whorl 47.

The drive shaft 58 is supported in regularly spaced apart flange bearings 59, which are bolted to one of the side members 69 or 70. For example, the flange bearings 59 for the drive shaft 58 may be provided at each third spinning position. In order to make use of the precision manufactured side members 69 and 70, it is preferred to provide an arrangement of adjusting pins 123, 124 and bores 97, 98 between the flange bearings 59 and the respective side members 69 or 70.

The cover 38 of each spinning position 1 is pivotable about the axis of shaft 43, which is supported between the side members 69 and 70. For this purpose, the side member 69 and 70 mount molded sleeves 142 and 143 (FIG. 3) into which the shaft 43 is inserted.

The brace 22 (122 in FIG. 7) is used as a support for the tensioning roll 18 and its spring biasing means. For this purpose, the post 34 is mounted on the brace 22, and the pivoting arm 35 is rotatably mounted on the post 34. The arm 35 in turn mounts the tensioning roll 18 at its free end. Also, the pivoting arm 35 is biased by the leaf spring 36 in a direction toward the tangential belt 17. The spring 36 is attached to the brace 22 (122 in FIG. 7) by means of a separate bracket 37. This bracket 37 also serves for holding the suction line 8. When the apparatus is shut down, i.e., with the belt 17, 19 being inoperative, the tensioning roll 18 and its pivoting arm 35 may be easily withdrawn from the post 34.

Figure 6:
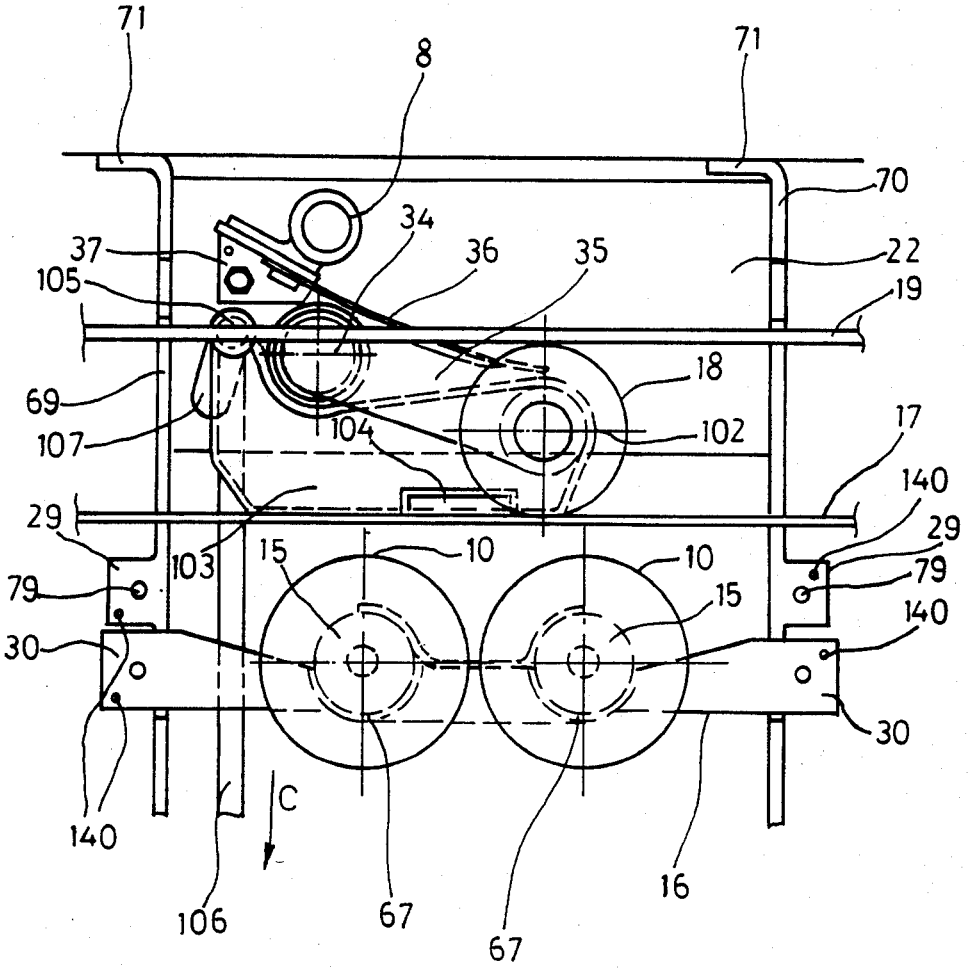
FIG. 6 is a fragmentary view similar to a portion of FIG. 3 with the bearing support means for the rotor shaft having been disconnected and lowered from its operative position.

In the embodiment of FIG. 6, a pivotable brake arm 103 is mounted with a bearing 102 on the pivoting arm 35 in coaxial relationship with the tensioning roll 18. The brake arm 103 is provided with a brake lining 104, which is adapted to become operative on shaft 9 of the spinning rotor. When the free end of the brake arm 103 is pulled down, the brake lining 104 contacts the shaft 9, which then serves as a pivot point for the brake arm 103, so that the tensioning roll 18 is subsequently raised. The free end of the brake arm 103 contains an opening which receives the turned end 105 of an actuating rod 106. The actuating rod 106 is guided with its turned end 105 in a guide slot 107 of the brace 22 (122 in FIG. 7), and is held by a locking pin 108. The turned end 105 is loosely received in the opening at the free end of the brake arm 103, so that the pivoting arm 35 can be readily removed together with the brake arm 103.

Figure 7:
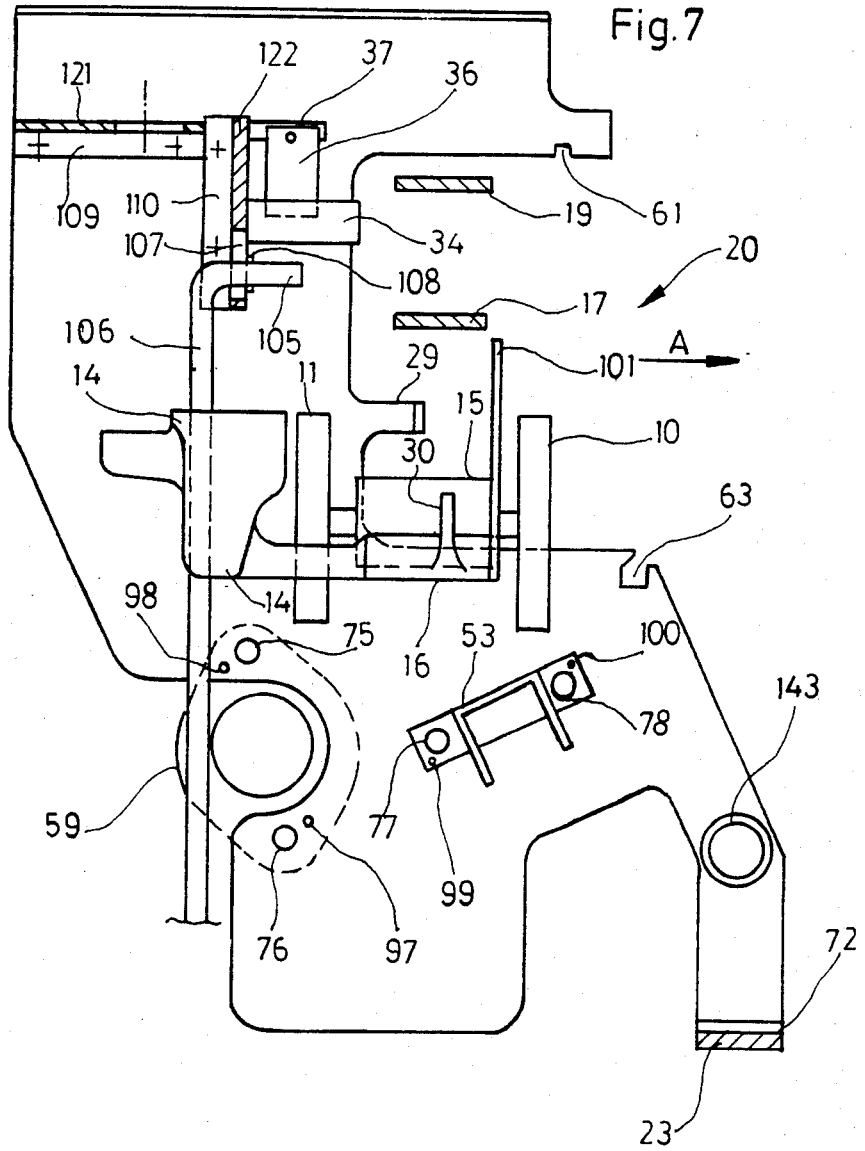
FIG. 7 is a view similar to FIG. 4, but illustrating a somewhat modified embodiment of the invention.

The embodiment of FIG. 7 differs from the foregoing embodiment esentially in that the two upper braces 121 and 122 are not parallel to each other, but are arranged perpendicular to each other. In particular, the front brace 122 which is adjacent the belt 17, 19, is arranged vertically, whereas the rear brace 121 extends horizontally. The braces 121 and 122 have flanged ends 109 and 110 by which they are attached to the side members 69 and 70, preferably by bolts. With the exception of this difference, the embodiments shown in FIGS. 7 and 4 correspond to each other, so that the following description applies to both of these figures. As shown in FIG. 4, the brace 22 (122 in FIG. 7) includes bores 81 and 82, which serve to accommodate fastening bolts by which the post 34 is mounted thereto. The braces 21, 22 further include apertures 73 and 74, through which the suction line 8 extends. In contrast thereto, the brace 122 in FIG. 7 is at a lower vertical elevation, so that the suction line 8 can extend thereabove.

The flange 29 which is located in the area of the recess 84 is provided with a bore 79 for accommodating a fastening bolt 31 of the bearing support bracket 16. If desired, the bore 79 may be threaded. As can be best seen in FIGS. 4 and 7, the flange bearing 59 is located in the area of the recess 83 of the side members 69 and 70, so that if necessary, the drive shaft 58 can be disassembled without interference by the side members. Also, the flange bearing 59 and the respective side members 70 are provided with bores 75 and 76 corresponding with each other and serving to accommodate the fastening bolts. On side members 70, adjusting pins 123 and 124 are additionally provided for the flange bearing, which are received in the bores 97 and 98 of the flange bearing 59.

The bores 77 and 78 of the side members serve to accommodate the fastening bolts for the bracket 53. The adjusting pins 125 and 126 are arranged on the side member 70, to which the bores 99, 100 of the flange of the bracket 53 are associated.

Also referring to FIGS. 4 and 7, the tangential belt 48, 50 which serves to drive the opening roll 4, is located in the area of the lower recess 85 formed in the side members 69 and 70, so that the tangential belt may be exchanged without interference.

Figure 8:
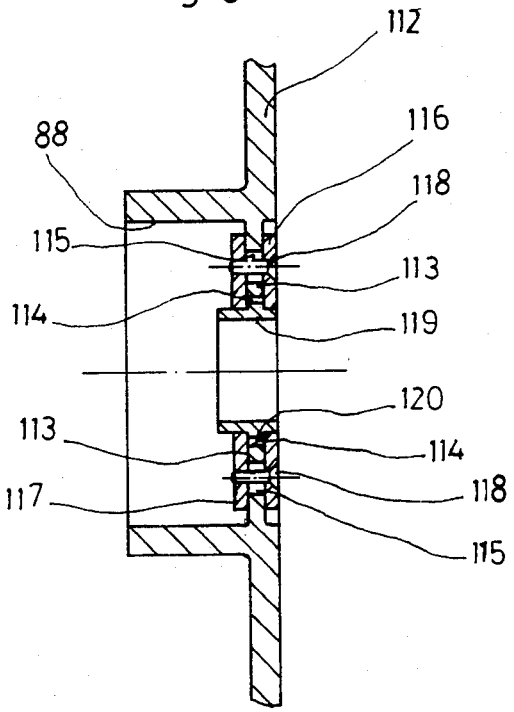
FIG. 8 is a vertical sectional view of the rear wall of the rotor housing and illustrating the means for sealing the rotor housing to the rotor shaft.

FIG. 8 illustrates a preferred embodiment of a seal between the rotor housing 7 and the rotor shaft 9. As will be understood, the interior of the rotor housing is under a partial vacuum, and the seal serves for sealing the interior space of the housing and limiting the air which can enter into the housing between the rear wall 112 and the shaft 9. The rear wall 112 is provided with a ring collar 88 which includes an internal flange 113 having at least two bores 115 through which fastening bolts 118 extend, with the bolts 118 having a diameter substantially smaller than that of the bores 115. The fastening bolts 118 serve to hold two annular discs 116 and 117, which are arranged on opposite sides of the internal flange 113. A ring collar 120 with a sealing sleeve 119 extends between the two annular discs 116 and 117. The outside diameter of the ring collar 120 is smaller than that of the flange 113, so that an annular gap 114 is formed therebetween. Thus the sleeve 119 is adapted to randomly move in the radial direction due to the play in the bores 115 and due to the annular gap 114, so that the sleeve 119 may be exactly aligned with the shaft 9, or to a ring collar on the end of the rotor 2. Preferably, the sleeve 119 consists of a plastic material having good antifriction properties.

The above described embodiments of the open end yarn spinning apparatus render it possible to readily open each spinning position and so that the individual components of each position are readily accessible without thereby affecting the adjacent spinning positions. For example, it is possible to remove a complete rotor bearing while the open end yarn spinning apparatus is in operation, i.e., to remove the bearing support bracket 16 with the pairs of supporting discs 10 and 11 and the thrust bearing housing 14. To insure that the operator is not injured by the tangential belt 17, 19 which continues to run, there is provided in the embodiment of FIG. 7 a cover plate 101 which is attached to the bearing bracket, which shields the area of the belt 17, 19 forwardly on the operating side. The cover plate 101 is of course provided with an opening through which the shaft 9 of the spinning rotor can be inserted.

It is also readily possible to remove the complete feed and fiber separating system without interfering with the operation of the adjacent spinning positions. Such removal is accomplished by loosening the bracket 53. When the tangential belt 17, 19 is stopped, it is also possible to remove the tensioning roll 18 with its pivoting arm 35 and brake arm 103. Similarly, it is readily possible to replace the tangential belt 17, 19.

In the drawings and specification, there has been set forth preferred embodiments of the invention, and although specific terms are employed, they are used in a generic and descriptive sense only and not for purposes of limitation.

That which is claimed is:

1. In an open end yarn spinning apparatus comprising a plurality of side by side spinning positions arranged longitudinally along the apparatus, and characterized in that the internal components of each spinning position are readily accessible without affecting adjacent positions, and with each spinning position including a circular spinning rotor having a rotor shaft coaxially fixed thereto; bearing means rotatably mounting said rotor shaft while permitting the axial withdrawal of said rotor and shaft; a rotor housing generally surrounding the periphery of said spinning rotor and having a rear wall with an opening receiving said rotor shaft therethrough; fiber delivery means including a feed roll and an opening roll for delivering fibers to said spinning rotor; and a cover pivotally mounted so as to selectively overlie such position, the improvement wherein said rotor housing of each spinning position is separate from the rotor housings of adjacent positions and wherein said yarn spinning apparatus further comprises a central frame extending longitudinally along the length of the apparatus, a frame subassembly fixedly mounted to said central frame at each of said spinning positions, means mounting said bearing means of each spinning position to the associated frame subassembly, means mounting said feed roll and said opening roll of said fiber delivery means of each spinning position to the associated frame subassembly, and means releaseably mounting said rotor housing of each spinning position to the associated frame subassembly and so that the rotor housing of each spinning position may be separately removed without affecting the adjacent positions, whereby the internal components of each spinning position are readily accessible by opening its cover and removing the rotor and rotor shaft, and the rotor housing.

2. The open end yarn spinning apparatus as defined in claim 1 wherein said means releasably mounting said rotor housing of each spinning position comprises a pair of oppositely directed and spaced apart slots formed on one of either said frame subassembly and said rotor housing, and a pair of oppositely directed and spaced apart tongues on the other of said frame subassembly and said rotor housing, with the separation distance between the bottoms of said slots being different from the separation distance between the extremities of said tongues, whereby the housing may be releasably assembled to said frame subassembly by inserting one tongue into an associated slot and pivoting the housing to align the other tongue with its associated slot, and then moving the housing so that the other tongue moves into the associated slot.

3. The open end yarn spinning apparatus as defined in claim 2 wherein one of said slots has a greater depth than the other slot, and wherein said means releasably mounting said rotor housing of each spinning position further comprises spring biasing means for resiliently biasing said rotor housing in a direction toward the slot of lesser depth so as to retain said tongues within the associated slots.

4. In an open end yarn spinning apparatus comprising a plurality of side by side spinning positions arranged longitudinally along the apparatus, and characterized in that the internal components of each spinning position are readily accessible without affecting adjacent positions, and with each spinning position including a spinning rotor having a forward side adapted to receive fibers, and a rearward side having a rotor shaft coaxially fixed thereto; bearing means rotatably mounting said rotor shaft while permitting the axial withdrawal of said rotor and rotor shaft in the forward direction; a rotor housing generally surrounding the periphery of said rotor and having a rear wall with an opening receiving said rotor shaft therethrough; fiber delivery means including a feed roll, an opening roll, and a fiber delivery duct for delivering fibers to the forward side of said rotor; a cover pivotally mounted so as to selectively overlie such position, with said cover mounting a closure insert which is adapted to overlie the forward side of said rotor when the cover is closed and with said closure insert including at least a portion of said fiber delivery duct and a yarn removal duct, the improvement wherein said yarn spinning apparatus further comprises a central frame extending longitudinally along the length of the apparatus, a frame subassembly fixedly mounted to said central frame at each of said spinning positions, with each frame subassembly comprising a pair of longitudinally spaced apart side members fixed to said central frame and extending generally parallel to each other in the transverse direction, and support means extending longitudinally between and fixed to each of the associated side members, means mounting said bearing means of each spinning position to the associated frame subassembly, means mounting said feed roll and said opening roll of said fiber delivery means of each spinning position to the associated frame subassembly, and means releaseably mounting said rotor housing of each spinning position to the associated frame subassembly and without engaging the frame subassemblies of the adjacent spinning positions, whereby the internal components of each spinning position are readily accessible by opening its cover and removing the rotor and rotor shaft, and the rotor housing.

5. The open end yarn spinning apparatus as defined in claim 4 wherein each of said side members is in the form of a generally flat metal plate.

6. The open end yarn spinning apparatus as defined in claim 5 wherein said central frame includes a channel member extending in the longitudinal direction along the upper portion of said apparatus, and said side members are affixed to and generally depend from said channel member.

7. The open end yarn spinning apparatus as defined in claim 6 wherein said support means of each of said frame subassemblies includes a plurality of separate braces fixed to each of the associated side members.

8. The open end yarn spinning apparatus as defined in claim 4 wherein each of said bearing means includes two pairs of supporting discs, with one disc of each pair being mounted to a common shaft, and with the discs of each pair being longitudinally separated and aligned so as to support the rotor shaft in a wedge-like gap formed between the outer surfaces of such pair of discs, each of said bearing means further including a bearing rotatably supporting each of said common shafts, a bracket supporting each of said bearings, and with said bracket being fixed to said side members of the associated frame subassembly.

9. The open end yarn spinning apparatus as defined in claim 8 wherein said central frame includes a channel member extending in the longitudinal direction along the upper portion of said apparatus, and wherein each of said side members of each of said frame subassemblies is in the form of a generally flat plate which generally depends from said channel member, and with each of said plates further defining a forward edge.

10. The open end yarn spinning apparatus as defined in claim 9 wherein each of said side members of each frame subassembly includes a rearwardly extending recess in said forward edge thereof, and wherein said bracket supporting said bearings is fixed to the associated side members adjacent said recesses.

11. The open end yarn spinning apparatus as defined in claim 8 further comprising means for fixedly attaching each of said brackets to the associated side members and including a flange on each side member which has a forward surface adapted to receive a portion of said bracket thereagainst, bolt means extending between each flange and associated bracket, and alignment means including a pin and bore on the respective contiguous surfaces of each flange and bracket for facilitating the initial alignment thereof during the assembly procedure.

12. The open end yarn spinning apparatus as defined in claim 4 wherein said support means of each of said frame subassemblies includes a plurality of separate braces fixedly joined to each of the associated side members, and wherein at least one of said separate braces extends between the adjacent side members of adjacent spinning positions to interconnect the frame subassemblies thereof.

13. The open end yarn spinning apparatus as defined in claim 4 wherein said means releaseably mounting said rotor housing to said frame subassembly comprises a pair of oppositely directed slots formed in each of said side members, and a pair of oppositely directed tongues on each side of said rotor housing, with the tongues of each pair being received in respective ones of the pair of slots of one side member when in the assembled condition, and spring biasing means for resiliently biasing said rotor housing in a direction which causes said tongues to be retained within the associated slots.

14. The open end yarn spinning apparatus as defined in claim 13 wherein said rotor housing of each spinning position is fabricated from a plastic material.

15. The open end yarn spinning apparatus as defined in claim 4 wherein said feed roll of each of said spinning positions includes a drive shaft, a housing rotatably mounting said drive shaft, and bracket means mounting said drive shaft housing to one of said side members.

16. The open end yarn spinning apparatus as defined in claim 15 wherein said bracket means includes a flange disposed against the surface of said one side member, bolt means extending between said flange and said one side member, and alignment means including a pin and bore on the respective contiguous surfaces of said flange and one side member for facilitating the initial alignment thereof during the assembly procedure.

17. The open end yarn spinning apparatus as defined in claim 15 wherein said fiber delivery means further includes a housing rotatably mounting said opening roll, means mounting said opening roll housing to said drive shaft housing of said feed roll so that said opening roll housing is pivotable about the axis of said feed roll drive shaft.

18. The open end yarn spinning apparatus as defined in claim 17 wherein said opening roll housing includes a first guide surface, and said closure insert of said cover includes a second guide surface which is adapted to engage said first guide surface to pivot said opening roll housing to its operative position upon closure of said cover.

19. The open end yarn spinning apparatus as defined in claim 4 further comprising suction means for drawing a partial vacuum within said rotor housing, and sealing means interposed between said rear wall opening of said rotor housing and said rotor shaft.

20. The open end yarn spinning apparatus as defined in claim 4 further comprising drive means for operatively rotating said rotor shaft of each spinning position and including a drive belt extending along the length of said apparatus, a tension roller pivotally mounted to said frame subassembly of each spinning position, and means for biasing each tension roller into contact with said drive belt so that said drive belt in turn contacts the associated rotor shaft.

21. The open end yarn spinning apparatus as defined in claim 20 wherein said means for biasing each tension roller into contact with said drive belt includes a first arm having one end pivotally mounted to the associated frame subassembly and an opposite end rotatably mounting said tension roller, a brake arm pivotally mounted to said first arm coaxially with said tension roller, a brake lining mounted on said brake arm at a location adjacent said rotor shaft, and rod means operatively connected to said brake arm for facilitating the manual pivoting of said brake arm so that said brake lining may be moved into braking contact with said rotor shaft and said tension roller may be withdrawn from said drive belt.

22. The open end yarn spinning apparatus as defined in claim 21 wherein said rod means extends through a slot in said support means of said frame subassembly, with said slot being oriented to limit movement of said rod means in a predetermined direction, and means for securing said rod means in said slot.

* * * * *